US006105400A

United States Patent [19]

Yoon

[11] Patent Number: 6,105,400

[45] Date of Patent: Aug. 22, 2000

[54] WARP KNITTED CUT PILE FABRIC HAVING OPENING PATTERN AND SUPERIOR ELASTICITY

[76] Inventor: Su-Gun Yoon, 684-18 Yoksam-dong, Kangnam-ku, Seoul 135-080, Rep. of Korea

[21] Appl. No.: 09/368,531

[22] Filed: Aug. 5, 1999

[30] Foreign Application Priority Data

Nov. 17, 1998 [KR] Rep. of Korea ..... 98-22336
Jan. 26, 1999 [KR] Rep. of Korea ..... 99-1026

[51] Int. Cl.[7] ..... D04B 21/02

[52] U.S. Cl. ..... 66/194; 66/195

[58] Field of Search ..... 66/169 R, 170, 66/191, 192–193, 194–202

[56] References Cited

U.S. PATENT DOCUMENTS

| | | | |
|---|---|---|---|
| 3,413,825 | 12/1968 | Winch | 66/195 |
| 3,468,139 | 9/1969 | Bitzer | 66/194 |
| 3,685,319 | 8/1972 | Jackson | 66/87 |
| 4,297,858 | 11/1981 | Blasberg et al. | 66/194 |
| 4,546,026 | 10/1985 | Kowalski | 428/91 |
| 4,570,461 | 2/1986 | Sawazaki . | |
| 5,065,600 | 11/1991 | Byles | 66/193 |
| 5,894,743 | 4/1999 | Bredemeyer et al. | 66/84 R |

FOREIGN PATENT DOCUMENTS 2-302762 of 0000 Japan .

*Primary Examiner*—Danny Worrell
*Attorney, Agent, or Firm*—Dinesh Agarwal, P.C.

[57] ABSTRACT

A warp knitted cut pile fabric having an opening pattern and superior elasticity, which is endowed with air permeability and decorative effect by forming openings therein. The warp knitted cut pile fabric is produced by the steps that a yarn (I) of elastic fiber components placed on the back bar (L1) is threaded 1 out 13 in and then is knitted in order of 8-9/8-7/8-9/8-7/8-9/7-6/5-4/3-2/1-0/1-2/1-0/1-2/1-0/2-3/4-5/6-7 patterns; a yarn (II) of non-elastic fiber components placed on the middle bar (L2) is threaded 13 in 1 out and then is knitted in order of 1-0/1-2/1-0/1-2/1-0/2-3/4-5/6-7/8-9/8-7/8-9/8- 7/8-9/7-6/4-5/3-2 patterns; and a yarn (III) of non-elastic fiber components placed on the front bar (L3) is threaded all, repeatedly knitted in order of 1-0/7-8/1-0/7-8/1-0/7-8/0-1/7–8/0-1/8-7/0-1/8-7/0-1/8-7/1-0/8-7 or 1-0/7-8 patterns over the base fabric of the knitted yarns (I) (II) and then the pile loop is formed during knitting of the yarn (III) and is cut to form same size openings in the directions of warp and weft on the surface of the knitted fabric.

5 Claims, 6 Drawing Sheets

L1
4-5/4-3/4-5/4-3/
4-5/4-3/3-2/2-1/
1-0/1-2/1-0/1-2/
1-0/1-2/2-3/3-4

L2
1-0/1-2/1-0/1-2/
1-0/1-2/2-3/3-4/
4-5/4-3/4-5/4-3/
4-5/4-3/3-2/2-1

L3
1-0/7-8/1-0/7-8/
1-0/7-8/0-1/7-8/
0-1/8-7/0-1/8-7/
0-1/8-7/1-0/8-7

L3
1-0/7-8

L1
8-9/8-7/8-9/8-7/
8-9/7-6/5-4/3-2/
1-0/1-2/1-0/1-2/
1-0/2-3/4-5/6-7

L2
1-0/1-2/1-0/1-2/
1-0/2-3/4-5/6-7/
8-9/8-7/8-9/8-7/
8-9/7-6/5-4/3-2

L3
1-0/7-8/1-0/7-8/
1-0/7-8/0-1/7-8/
0-1/8-7/0-1/8-7/
0-1/8-7/1-0/8-7

L3
1-0/7-8

WARP KNITTED CUT PILE FABRIC HAVING OPENING PATTERN AND SUPERIOR ELASTICITY

BACKGROUND OF THE INVENTION

1. Field of the Invention

This invention relates to a warp knitted cut pile fabric having opening pattern and superior elasticity, and more particularly speaking, to a warp knitted cut pile fabric which is endowed air permeability and decorative effect by forming openings on the warp knitted fabric.

2. Prior Art

Among knitted goods, warp knitted fabric is popular for outer garments of superior quality since it can be knitted various stitches and is easier to vary patterns than weft knitted fabric.

However, the elasticity of warp knitted fabrics is basically poor than weft knitted fabric owing to its structure. Furthermore, the elasticity of fabrics is required more and more since the recent fashion tendency is changing to the old style setting off the beauty of curved lines. Accordingly, much studies for endowing elastic property to the warp knitted fabrics are being tried. In addition, major nations advanced in fabrics such as Italy, France, Japan, Korea and the like are spending a great efforts to produce new warp knitted fabrics which can impress peculiar feeling by giving variety to the surface of fabrics in order to develop high value-added fabrics.

However, in case of the elastic warp knitted fabrics, it is difficult that the elastic yarn is knitted with other component yarn in viewpoint of the knitting structure. Moreover, in case of warp knitted cut pile fabrics, it is not easy to give variety to the surface of fabrics by changing patterns of cut piles since the cut piles are frequently come off from the grey fabric knitted and thus knitting of warp knitted cut pile fabrics is very complicated.

SUMMARY OF THE INVENTION

To meet said consumer's desire and the tendency of fabrics development in warp knitted fabrics, this inventor has studied and tested over again in various sides in order to develop the high value-added fabrics which can enhance wearing feeling by means of endowing elasticity and can give characteristic atmosphere by varying the appearance.

In result, this inventor worked out to develop high-grade warp knitted fabrics of new feeling which has elasticity as well as enhanced air permeability by means of forming opening pattern and fancy and rhythmical feeling by means of giving varieties on the external of the fabrics.

The present invention will be better understood and objects other than those set forth above will become apparent when consideration is given to the following detailed description thereof. Such description makes reference to the annexed drawings wherein:

BRIEF DESCRIPTION OF THE ATTACHED DRAWINGS

FIG. 1(2) is a knitting diagram of a yarn of non-elastic fiber component placed on a middle bar (L2);

FIG. 1(3) is a knitting diagram of a yarn of non-elastic fiber component placed on a front bar (L3);

FIG. 1(4) is a knitting diagram shown another example of the front bar (L3) of said FIG. 1(3);

FIG. 2(2) is a united knitting diagram of the FIGS. 1(1), 1(2) and 1(4) as one repeat unit of an embodiment of the present invention illustrated in FIG. 1;

FIG. 4 (2) is a knitting diagram of a yarn of non-elastic fiber component placed on a middle bar (L2);

FIG. 4 (3) is a knitting diagram of a yarn of non-elastic fiber component placed on a front bar (L3);

FIG. 4(4) is a knitting diagram shown another example of the front bar (L3) of said FIG. 4(3);

FIG. 5(2) is a united knitting diagram of the FIGS. 4(1), 4(2) and 4(4) as one repeat unit of another embodiment of the present invention illustrated in FIG. 4.

DETAILED DESCRIPTION OF THE PREFERRED EMBODIMENT

Figure 1:
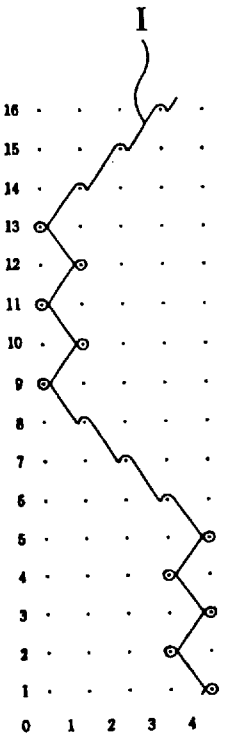
FIG. 1 is a knitting drawing of each yarn as an embodiment according to the warp knitted cut pile fabric having opening pattern and superior elasticity of this invention, FIG. 1(1) is a knitting diagram of a yarn of elastic fiber component placed on a back bar (L1)
Figure 1:
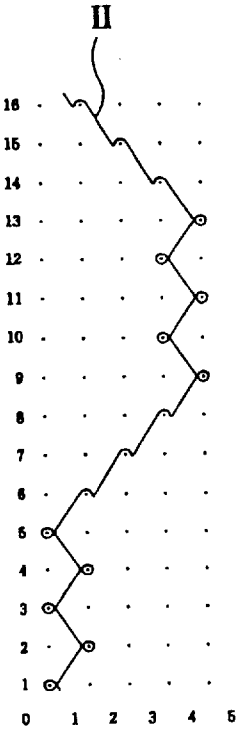
Figure 1:
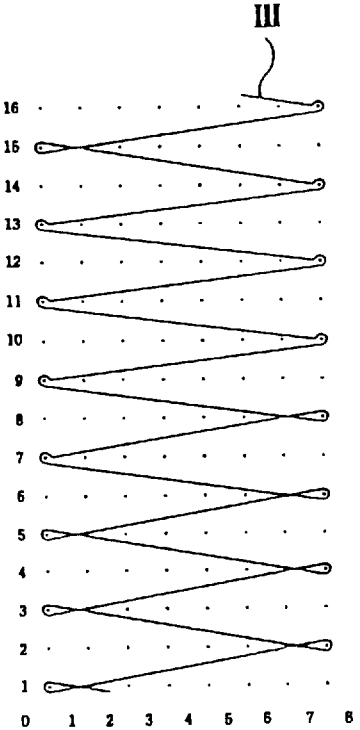
Figure 1:
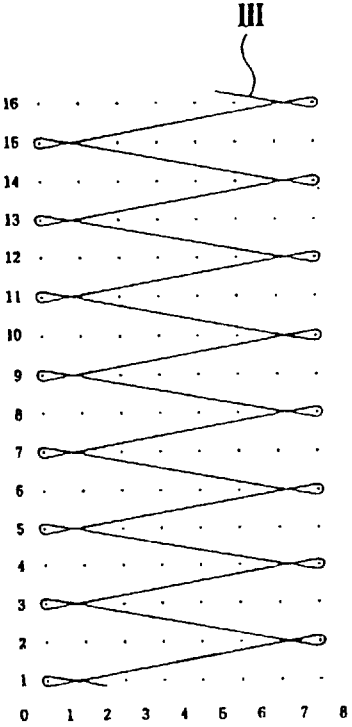

This invention provides a warp knitted cut pile fabric having opening pattern, what is called mesh velvet, which is knitted by a warp knitting machine comprising of the following three bars; a back bar (L1) placed a yarn of elastic fiber component thereon and a middle bar (L2) and a front bar (L3) respectively placed a yarn of non-elastic fiber component thereon, is characterized in that:

said warp knitted cut pile fabric having opening pattern and superior elasticity is produced by the steps that a yarn (I) of elastic fiber component placed on the back bar (L1) of 1 out 13 in threading is knitted in pattern order of 8-9/8-7/8-9/8-7/8-9/7-6/5-4/3-2/1-0/1-2/1-0/1-2/1-0/2-3/4-5/6-7 by means of a pattern wheel or pattern chain; a yarn (II) of non-elastic fiber component placed on the middle bar (L2) of 13 in 1 out threading is knitted in pattern order of 1-0/1-2/1-0/1-2/1-0/2-3/4-5/6-7/8-9/8-7/8-9/8-7/8-9/7-6/4-5/3-2 by means of a pattern wheel or pattern chain; and a yarn (III) of non-elastic fiber component placed on the front bar (L3) of full threading is repeatedly knitted in pattern order of 1-0/7-8/1-0/7-8/1-0/7-8/0-1/7-8/0-1/8-7/0-1/8-7/0-1/8-7/1-0/8-7 or 1-0/7-8 to form the pile loops over the base knitted by said knitted yarns (I) (II) and then the formed pile loop is cut thereby same size of small openings are regularly formed in directions of warp and weft on the surface of knitted fabric.

And, it is characterized in that said yarn (I) of elastic fiber component placed on the back bar (L1) and said yarn (II) of non-elastic fiber component placed on the middle bar (L2)

are knitted in a manner that the interval is narrowed till 10 needles or the interval is widen over 15 needles on the basis of 14th needle toward wale direction and thereby the number of opening pattern in the unit area can be increased or reduced.

Also, the vertical lengths of opening (IV) and the space between openings (IV) can be varied by extending 30 courses further or reducing 12 courses on the basis of 16 course of one repeat unit of said yarn (I) of elastic fiber component placed on the back bar (L1), said yarn (II) of non-elastic fiber component placed on the middle bar (L2) and said yarn (III) of non-elastic fiber component placed on the front bar (L3).

Accordingly, the opening pattern formed in this way can be formed in the shape of regular square, rectangle, circle or oval since its length is changed according to the knitting course of one repeat unit and the opening pattern is harmonized with cut piles. Said opening pattern can be changed depending on the length of cut pile.

Said back bar (L1), middle bar (L2) and front bar (L3) can be knitted in the manner of varying the loop pattern to the open or close stitch within the moving range of 1 needle to 4 needles for 1 course.

In accordance with this invention, stripes can be formed by means of inserting or omitting warps at regular or irregular intervals to the out portion of threading in said back bar (L1) and said middle bar (L2).

Said yarn (III) of non-elastic fiber component placed on the front bar (L3), knitted into said 1-0/7-8 pattern chain can be knitted into the pattern of 1-0/3-4, 1-0/4-5, 1-0/5-6, 1-0/7-8, 1-0/9-10 or more depending on the length of pile loop to be needed thereby the length of loop to be floated is increased or decreased.

Namely, in accordance with this invention, the warp knitted cut pile fabric having opening patterns and superior elasticity can increase the number of opening per the unit area by threading the yarn (I) of elastic fiber component of said back bar (L1) with 1 out 3 in and the yarn (II) of non-elastic fiber component of said middle bar (L2) with 3 in 1 out to form openings closely and regularly throughout fabrics, and also can reduce the number of opening per the unit area by threading and knitting the yarn (I) of elastic fiber component of said back bar (L1) with 1 out 28 in and the yarn (II) of non-elastic fiber component of said middle bar (L2) with 28 in 1 out.

As the yarn (I) of elastic fiber component of said back bar (L1), that is the elastomeric yarn, it is exemplified that polyester elastomer, polyamide elastomer, polyurethane elastomer, elastomer of fluorine series, polycarbonate elastomer or synthetic rubber. Among these the polyurethane is the most desirable.

Said elastic yarn can be used in the form of bare yarn or covered yarn and the fineness is properly selected in the range of 30D~50D.

Polyurethane elastomer is obtained by reacting polymer diol such as polyester diol, polyether diol, polycarbonate, etc., with chain-lengthening agents of low molecule or terminal-stopping agents. Among the above, it is most preferred that the elastic yarn formed from polyurethane elastomer of polyether type is used because of its excellent heat stability.

Moreover, polyester fiber, polyamide fiber, rayon fiber or mixing fiber thereof can be used as the yarn (II) of non-elastic fiber component of said middle bar (L2) and the yarn (III) of non-elastic fiber component of said front bar (L3) and their fineness can be selected between 15D and 100D depending on the thickness of the last knitted fabrics.

Usually, polyester fiber, polyamide fiber and the like are used with a filament state as the yarn (II) of non-elastic fiber component of said middle bar (L2). However, every type of yarns such as twisted yarn, crimped stretch yarn, etc. can be also used for the yarn (II) paying regard to the touch feeling and elasticity of the last knitted fabric. For the yarn (III) of non-elastic fiber component of said front bar (L3), only filament yarn can be applied because the yarn (III) should be erected after to be cut the knitted loop.

This invention can further be knitted as the following. Said warp knitted cut pile fabric having opening pattern and superior elasticity is produced by the steps that a yarn (I) of elastic fiber component placed on the back bar (L1) of 1 out 13 in threading is knitted in pattern order of 8-9/8-7/8-9/8-7/8-9/7-6/4-5/3-2/1-2/1-0/1-2/1-0/1-2/3-2/4-5/7-6 by means of a pattern wheel or pattern chain; a yarn (II) of non-elastic fiber component placed on the middle bar (L2) of 13 in 1 out threading is knitted in pattern order of 1-0/1-2/1-0/1-2/1-0/2-3/5-4/6-7/8-7/8-9/8-7/8-9/8-7/6-7/5-4/2-3 by means of a pattern wheel or pattern chain; and a yarn (III) of non-elastic fiber component placed on the front bar (L3) of full threading is repeatedly knitted in pattern order of 1-0/7-8 to form the pile loops over the base knitted by said knitted yarns (I) (II) and then the formed pile loop is cut thereby same size of small openings are regularly formed in directions of warp and weft on the surface of knitted fabric.

The detailed illustration about the knitting process of a warp knitted cut pile fabric having opening pattern and superior elasticity of the present invention referring to attached Figures is as follows.

Figure 2:
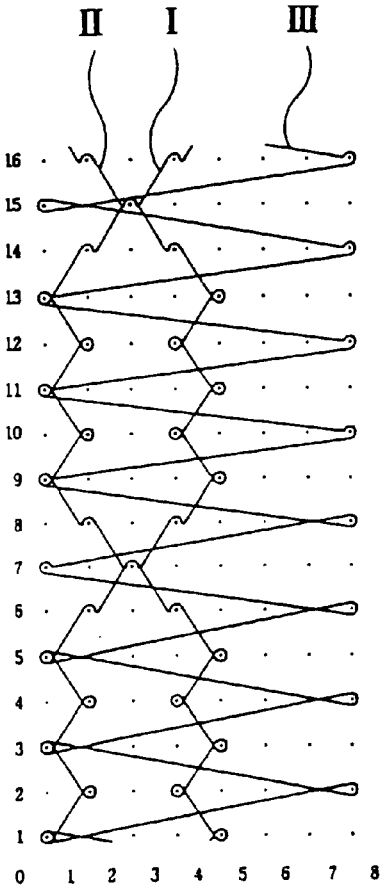
FIG. 2(1) is a united knitting diagram of the FIGS. 1(1), 1(2) and 1(3) as one repeat unit of an embodiment of the present invention illustrated in FIG. 1.
Figure 2:
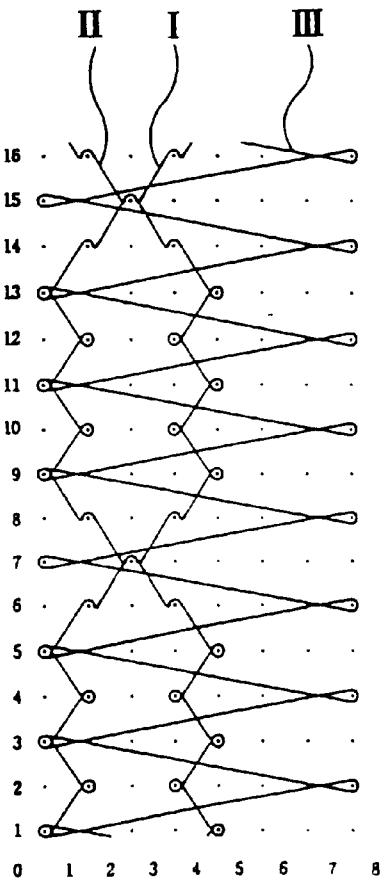
Figure 3:
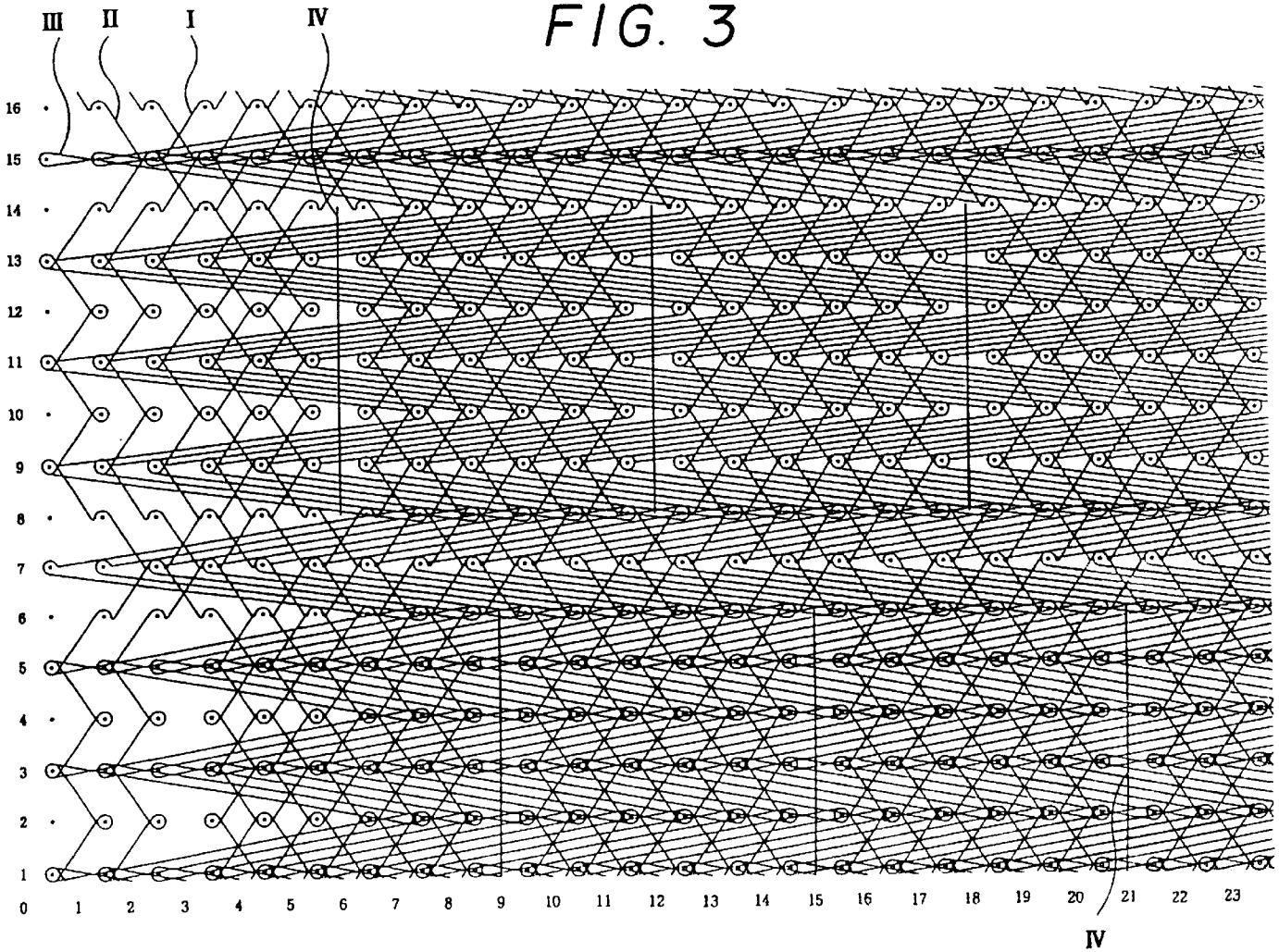
FIG. 3 is an enlarged knitting drawing shown openings formed by repeatedly knitting one repeat unit of said FIG. 2(1)

An embodiment in accordance with the present invention of 5:1 threading that the yarn (I) of elastic fiber component placed on said back bar (L1) is threaded 1 out 5 in and the yarn (II) of non-elastic fiber component placed on said middle bar (L2) is threaded 5 in 1 out is illustrated in the FIG. 1 to FIG. 3. Also, in the FIG. 4 to FIG. 6, it is illustrated for 13:1 threading as an another embodiment in accordance with the present invention that the yarn (I) of elastic fiber component placed on said back bar (L1) is threaded 1 out 13 in and the yarn (II) of non-elastic fiber component placed on said middle bar (L2) is threaded 13 in 1 out. In this case, the yarn (III) of non-elastic fiber component placed on the front bar (L3) is full threaded in every case.

In the case of the former 5:1 threading, the yarn (I) of elastic fiber component placed on said back bar (L1) is knitted in pattern order of 4-5/4-3/4-5/4-3/4-5/4-3/3-2/2-1/1-0/1-2/1-0/1-2/1-0/1-2/2-3/3-4 and the yarn (II) of non-elastic fiber component placed on said middle bar (L2) is knitted in pattern order of 1-0/1-2/1-0/1-2/1-0/1-2/2-3/3-4/4-5/4-3/4-5/4-3/4-5/4-3/3-2/2-1 and in the latter 13:1 threading, the yarn (I) of elastic fiber component placed on said back bar (L1) is knitted in pattern order of 8-9/8-7/8-9/8-7/8-9/7-6/5-4/3-2/1-0/1-2/1-0/1-2/1-0/2-3/4-5/6-7 and the yarn (II) of non-elastic fiber component placed on the middle bar (L2) is knitted in pattern order of 1-0/1-2/1-0/1-2/1-0/2-3/4-5/6-7/8-9/8-7/8-9/8-7/8-9/7-6/4-5/3-2 thereby openings (IV) are formed. After this, said formed openings (IV) are covered by the knitting of the yarn (III) of non-elastic fiber component placed on the front bar (L3) but the openings (IV) are distinctly appeared by cutting the yarn (III) of non-elastic fiber component placed on the front bar (L3).

Also, in the case of 7:1 threading, 9:1 threading or 11:1 threading, L1 bar is respectively knitted in pattern order of 5-6/5-4/5-6/5-4/5-6/5-4/3-2/2-1/1-0/1-2/1-0/1-2/1-0/1-2/3-4/4-5(7:1); 6-7/6-5/6-7/6-5/6-7/5-4/4-3/2-1/1-0/1-2/1-0/1-2/1-0/2- 3/3-4/5-6(9:1); 7-8/7-6/7-8/7-6/7-8/7-6/5-4/3-2/1-0/

1-2/1-0/1-2/1-0/1-2/3-4/5-6(11:1) and L2 bar is respectively knitted with 1-0/1-2/1-0/1-2/1-0/1-2/3-4/4-5/5-6/5-4/5-6/5-4/5-6/5-4/3-2/2-1(7:1); 1-0/1-2/1-0/1-2/1-0/2-3/3-4/5-6/6-7/6-5/6-7/6-5/6-7/5-4/3-2/2-1(9:1); 1-0/1-2/1-0/1-2/1-0/1-2/3-4/5-6/7-8/7-6/7-8/7-6/7-8/7-6/5-4/3-2(11:1) and thereby many openings of same size are regularly formed at a certain intervals. The knitting array regarding to other than said threading is omitted since fabrics are composed of the same manner as mentioned above for the brevity of explanation.

Also, it can be knitted in pattern order as the following. In the case of the former 5:1 threading, the yarn (I) of elastic fiber component placed on said back bar (L1) is knitted in pattern order of 4-5/4-3/4-5/4-3/4-5/4-3/2-3/1-0/1-2/1-0/1-2/1-0/1-2/1-0/2-3/4-3 and the yarn (II) of non-elastic fiber component placed on said middle bar (L2) is knitted in pattern order of 1-0/1-2/1-0/1-2/1-0/1-2/3-2/4-5/4-3/4-5/4-3/4-5/4-3/4-5/3-2/1-2.

Figure 4:
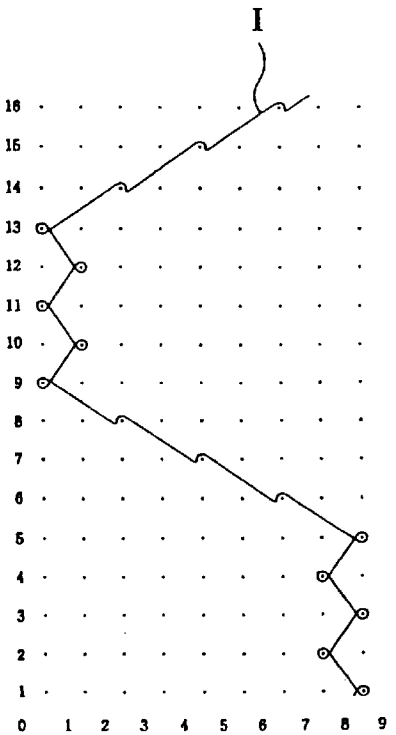
FIG. 4 is a knitting drawing of each yarn as another embodiment of this invention, similar to said FIG. 1, FIG. 4(1) is a knitting diagram of a yarn of elastic fiber component placed on a back bar (L1)
Figure 4:
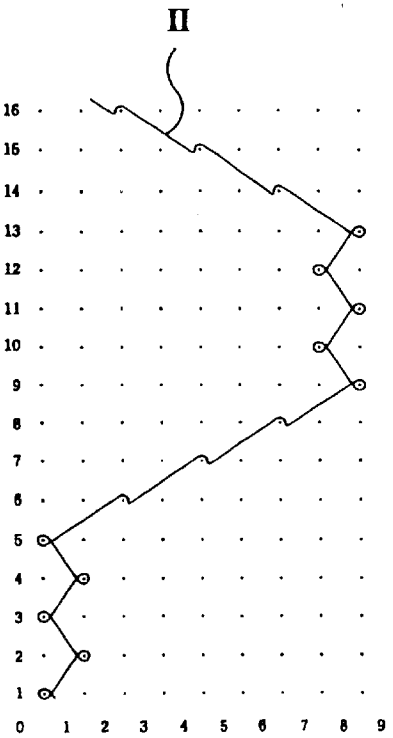
Figure 4:
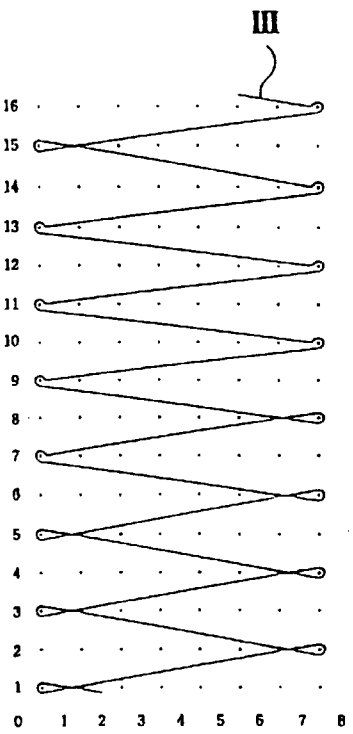
Figure 4:
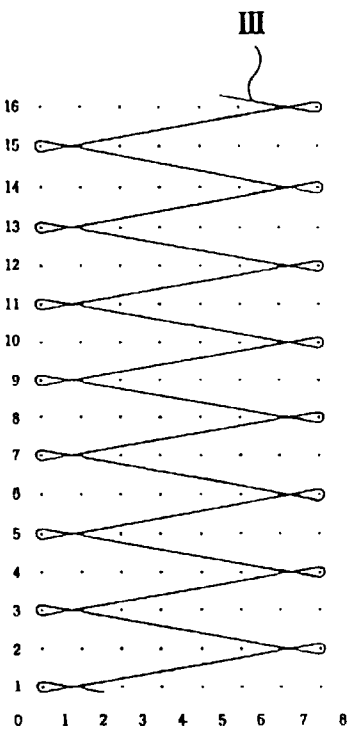
Figure 5:
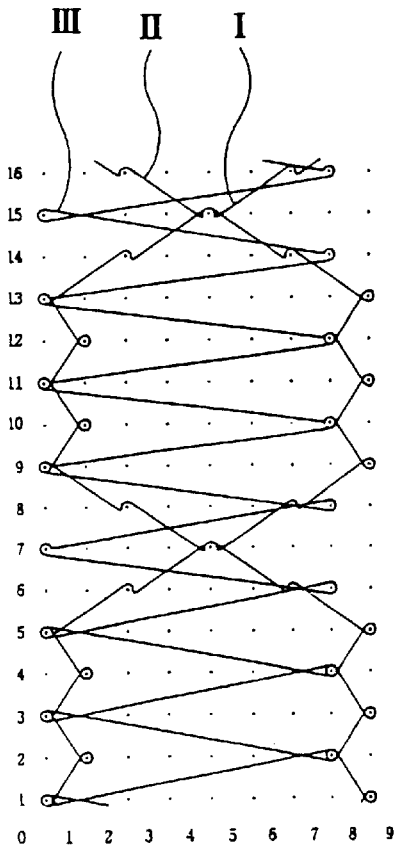
FIG. 5(1) is a united knitting diagram of the FIGS. 4(1), 4(2) and 4(3) as one repeat unit of another embodiment of the present invention illustrated in FIG. 4.
Figure 5:
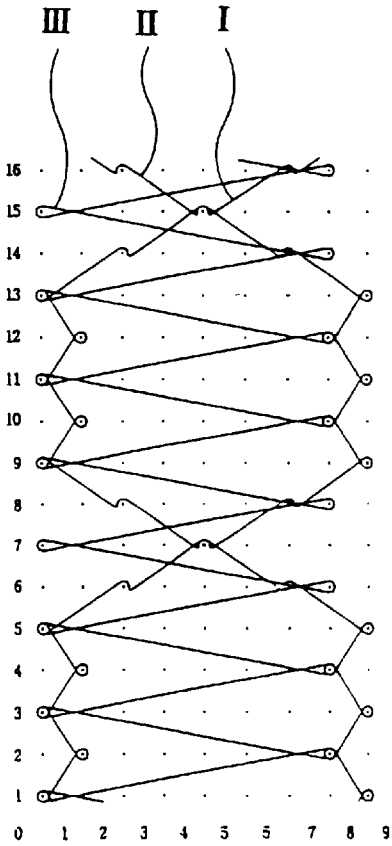
Figure 6:
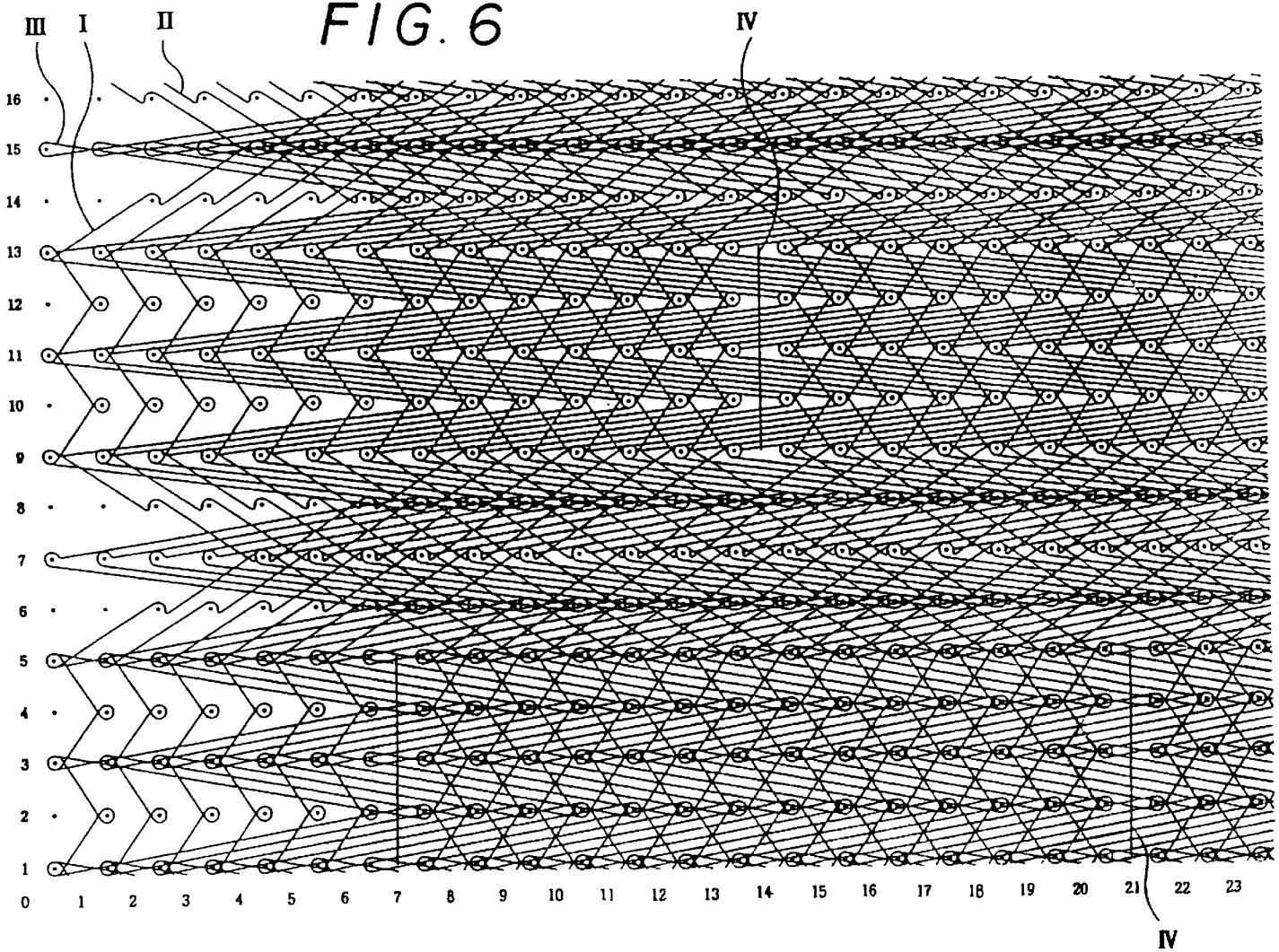
FIG. 6 is an enlarged knitting drawing shown openings formed by repeatedly knitting one repeat unit of said FIG. 5(1).

As indicated in FIG. 1 and FIG. 4, the yarn (I) of elastic fiber component placed on the back bar (L1) is partially threaded 1 out 5 in and 5 in 1 out and the yarn (II) of non-elastic fiber component placed on the middle bar (L2) is partially threaded 1 out 13 in and 13 in 1 out respectively, thereby a base fabric is knitted. As shown in FIG. 3, openings (IV) indicated in enlarged size are formed at a certain size by separating next of 5th and 11th in wale on said base fabric and the pattern of grey fabric is made by forming openings regularly at a plural portions in this way. FIG. 6 also shows opening pattern made by forming openings in the same way.

The yarn (II) of non-elastic fiber component is covered on the elastic yarn (I) and thus said elastic yarn (I) is inserted into the yarn (II) of non-elastic fiber component in order to protect the elastic yarn (I) from physical damage and excessive elongation.

Further, it is desirable that the yarn (III) of non-elastic fiber component threaded in the front bar (L3) is knitted in order of 1-0/7-8/1-0/7-8/1-0/7-8/0-1/7-8/0-1/8-7/0-1/8-7/0-1/8-7/1-0/8-7 or 1-0/8-7 to form the pile loop and the yarn (III) can be varyingly knitted within the limit of 1 needle to 4 needles for 1 course into open or close loop stitch. Also it can be knitted and cut with 1-0/6-5 or 1-0/12-11 depending on the length of the cut pile.

Three bars of back, middle and front bars (L1), (L2), (L3) are moved in the same way and accordingly a warp knitted cut pile fabric having opening pattern as shown in FIG. 3 and FIG. 6 is knitted, what is called mesh velvet. By being knitted in such way, the cut pile is never broken away in the subsequent finishing process even the middle portion of the loop in float state formed by the front bar (L3) is cut.

The grey knitted under said condition is gone through a shearing process thereby the length of the cut pile is evenly adjusted all over and it is subjected to a scouring process and a wet relaxing process to remove impurity in the grey and to restore the bulky property and the elastic property of the yarn comprising of the grey. Also, the occurrence of unlevel dyeing or wrinkle in a dyeing process is prevented through the above processes and the uneven grey caused by inserting an elastic yarn is become evenly and stabilized.

In the event that complex, delicate and exquisite dyeing next to said wet relaxing process is needed, it is good for level dyeing to dye the grey after the pre-setting that passes through said grey into a dye bath which temperature is 195±5° C., at the rate of 22±5 m/min. Then, the warp knitted cut pile fabric is completed through finishing process such as dehydration, rinsing, drying and the like.

While a preferred embodiment of the invention is described and illustrated in the following, the invention should not be limited thereto, but may be otherwise embodied within the scope of the following claims.

BEST MODE FOR CARRYING OUT THE INVENTION

In a tricot warp knitting machine having three bars, a polyurethane filament yarn which thickness is 40D (denier), in bear state was supplied to the back bar (L1) and a polyester filament yarn which thickness was 50D was respectively supplied to the middle bar (L2) and the front bar (L3). The back bar (L1) was threaded 1 out 5 in and then was knitted in order of 4-5/4-3/4-5/4-3/4-5/4-3/3-2/2-1/1-0/1-2/1-0/1-2/1-0/1-2/2-3/3-4 and the polyester filament yarn of said middle bar (L2) was threaded 5 in 1 out and was knitted in order of 1-0/1-2/1-0/1-2/1-0/1-2/2-3/3-4/4-5/4-3/4-5/4-3/4-5/4-3/3-2/2-1 thereby a base fabric having a plurality of openings in same size was knitted. Over said base fabric, the front bar (L3) was full threaded and was knitted in order of 1-0/7-8/1-0/7-8/1-0/7-8/0-1/7-8/0-1/8-7/0-1/8-7/0-1/8-7/1-0/8-7, and then a pile loop was erected vertically by being cut the middle portion of the polyester filament yarn floated by the front bar (L3).

After the grey obtained from said knitting was passed through shearing process, it was subjected to evenly adjust the pile length through the entire surface of fabric and was passed into multistage bathes included de-oiling agent and water softener under temperature to be elevated until 85° C. starting from 60° C. and maintained at room temperature in last bath to remove impurities such as oil, dust, etc. Then it is further subjected to wet relaxing process to evenly fasten the ends of fabric. After pre-setting at 25 m/min rate in 198° C. temperature, fabric was dyed in a dye bath that purplish red-disperse dye was mainly dissolved therein and the temperature thereof was 129° C. Thereafter, the dyed fabric was subjected to the finishing in order of dehydrating, washing and drying thereby the warp knitted cut pile fabric which has a plurality of openings spaced regularly in warp and weft directions and formed in the identical size was completed.

The warp knitted cut pile fabric completed in accordance with this invention gave characteristic feeling which can't saw so far, attributing to the openings, and said fabric had very soft touch as like a silk and was lustrous. Also, when the warp knitted cut pile fabric was sewed as an one-piece dress, the dress evoked elegant figure in wearing since the warp knitted cut pile fabric has excellence expandability and drapability. In addition, said fabric was free of wrinkle even wearing for a long time and was excellent in shape retention.

Further, warp knitted cut pile fabric obtained had unified sense entirely because the size of openings is same in warp and weft directions.

EFFECT OF THE INVENTION

According to the invention, the warp knitted cut pile fabric having opening pattern and superior elasticity of this invention, notwithstanding using elastic yarns is easily and harmoniously formed. Accordingly, it enhances wearing feeling because of excellent strength and elongation when the fabric is used for general clothes such as outdoor garments. Also, in the after treatment subsequent to the knitting process, cut piles are never broken away and taken out from the knitted fabric. Therefore, the fabric has more good cubic effect and the pleasant touch feeling of the fabrics is enhanced. It can keep elasticity for a long time because elastic yarns are also not break away the fabric and thus it has excellent durability and practicality. Above all, the warp knitted fabric of this invention is expected to be popular for costly fabrics such as high-grade dresses for females, especially one-piece dresses, blouses and the like since the fabric has great air permeability because of the uniform size of opening patterns formed on the fabric and aesthetic sense.

In addition to the opening pattern, this invention provides high-grade knitted fabrics having excellent drapability such as a silk by being harmonized soft touch and luster of the cut pile warp knitted fabric itself, and thereby this invention will help to export high value-added fabric products.

What has been described is considered only illustrative of the principles of this invention. Therefore, those skilled in the art can devise various embodiments of this invention in accordance with those principles within the sprit and scope thereof as encompassed by the following claims.

What is claimed is:

1. A warp knitted cut pile fabric having an opening pattern knitted by a warp knitting machine comprising a back bar (L1) for placing a yarn of an elastic fiber component thereon for endowing elasticity, and a middle bar (L2) and a front bar (L3), respectively, for placing a yarn of a non-elastic fiber component thereon, said warp knitted cut pile fabric comprising a yarn (I) of an elastic fiber component knitted in a pattern order of 8-9/8-7/8-9/8-7/8-9/7-6/5-4/3-2/1-0/1-2/1-0/1-2/1-0/2-3/4-5/6-7;

a yarn (II) of a non-elastic fiber component knitted in a pattern order of 1-0/1-2/1-0/1-2/1-0/2-3/4-5/6-7/8-9/8-7/8-9/8-7/8-9/7-6/4-5/3-2; and a yarn (III) of a non-elastic fiber component repeatedly knitted in a pattern order of 1-0/7-8/1-0/7-8/1-0/7-8/0-1/7-8/0-1/8-7/0-1/8-7/0-1/8-7/1-0/8-7 or 1-0/7-8 to form a pile loop over the base knitted by said knitted yarns (I) (II), wherein the pile loop is cut to form small openings in the directions of warp and weft on the surface of knitted fabric.

2. The warp knitted cut pile fabric as defined in claim 1, wherein said yarn (I) and said yarn (II) are knitted in a manner that the interval is narrowed to 10 needles or widened over 15 needles on the basis of 14th needle toward the wale direction to thereby increase or reduce the number of opening pattern in the unit area, and wherein the vertical lengths and the space between the openings can be varied by extending 30 courses further or reducing 12 courses on the basis of 16 course of one repeat unit of said yarn (I), said yarn (II) and said yarn (III).

3. The warp knitted cut pile fabric as defined in claim 1, wherein said yarn (III) knitted into said 1-0/7-8 pattern chain can be knitted into the pattern of 1-0/3-4, 1-0/4-5, 1-0/5-6, 1-0/7-8, 1-0/9-10 or more depending on the desired length of pile loop.

4. The warp knitted cut pile fabric as defined in claim 1, wherein the loop pattern can be varied to an open or close stitch.

5. The warp knitted cut pile fabric as defined in claim 1, further comprising stripes formed by inserting or omitting warps at regular or irregular intervals to the out portion of threading in said back bar (L1) and said middle bar (L2).

* * * * *